United States Patent [19]

Lichu

[11] Patent Number: 5,048,722

[45] Date of Patent: Sep. 17, 1991

[54] GAS IGNITION GLUE GUN

[76] Inventor: Wang C. Lichu, No 2, Sublane 10, Lane 136, Sec. 3, Chung Shan Road, Chung Ho City, Taipei Hsien, Taiwan

[21] Appl. No.: 424,640

[22] Filed: Oct. 20, 1989

[51] Int. Cl.[5] ..... B67D 5/66

[52] U.S. Cl. ..... 222/80; 222/113; 222/146.2; 126/401; 401/1

[58] Field of Search ..... 222/113, 146.1, 146.2, 222/146.5, 80, 391; 401/1, 2; 126/401, 409, 414

[56] References Cited

U.S. PATENT DOCUMENTS

| | | | |
|---|---|---|---|
| 4,523,705 | 6/1985 | Belanger et al. | 226/127 |
| 4,535,916 | 8/1985 | Mächerle et al. | 222/113 |
| 4,755,073 | 7/1988 | Girardin et al. | 401/1 |
| 4,795,064 | 1/1989 | Sheu | 222/113 |
| 4,949,881 | 8/1990 | Watanabe et al. | 222/113 |

FOREIGN PATENT DOCUMENTS 2612087 9/1988 France .

*Primary Examiner*—Michael S. Huppert
*Assistant Examiner*—Anthoula Pomrening
*Attorney, Agent, or Firm*—Lowe, Price, LeBlanc & Becker

[57] ABSTRACT

This invention relates to a kind of gas ignition glue gun and more particularly to one which uses a cutter to cut inserted glue stick into two halves, and uses gas to burn cotton asbestos to further heat a tubular insert, into which a glue stick is inserted, so as to efficiently melt the inserted glue stick into semiliquid for further output for sealing process by means of the operation of the feed control mechanism thereof.

3 Claims, 3 Drawing Sheets

GAS IGNITION GLUE GUN

BACKGROUND OF THE INVENTION

A regular glue gun is generally operated by means of AC power to melt a glue stick for sealing. The drawbacks of a conventional electric glue gun may include:

(1) Limited applicability: The application is limited by the availability of AC power supply and the moving range of the connected electric wire;

(2) Low efficiency: The heating velocity through electric heating wire is relatively slow. Sometimes, glue stick may be pushed out before it is completely melted; and (3) Easy to break out: The internal structure or the control knob tends to be damaged because there is no self-protective mechanism provided to control the feeding of glue after the feed control knob is pressed on or erroneously pressed on when glue sealing is not required.

There is a kind of gas heater glue gun outlined in U.S. Pat. No. 4,795,064. The drawbacks of this type of gas heater glue gun may include the following:

(1) Poor heating effect due to bottom heating process;

(2) Inconvenient in operation due to manual control on glue output;

(3) Flame volume control not available;

(4) Gas explosion problem tends to happen because no device is available to mix gas with air before burning;

(5) Melted glue tends to drop disorderly because no glue output control is available; and (6) Low combustion efficiency and high rate of heat loss.

The gas ignition glue gun of the present invention features:

(1) High heating velocity and efficiency through gas ignition;

(2) Rapid melting of glue stick through pre-treatment to cut glue stick into two halves by a heat cutter;

(3) Safety output control through the operation of a safety spring to prohibit against output of glue stick before it is completely melted.

(4) Control lever and internal structure protection. Feed control mechanism will work only after glue stick is completely melted, so as to prevent any erroneous operation.

(5) Free from limitation of working place because of gas heating process;

(6) Flame volume control available to stabilize heating temperature;

(7) Minimized gas consumption through burning of cotton asbestos;

(8) Automatic output control to freely control output amount of melted glue; and (9) Gas explosion problem is eliminated and gas consumption is reduced through pre-mixing process with air.

SUMMARY OF THE INVENTION

The present invention is related to a kind of glue gun and more particularly to a gas ignition glue gun which includes a gun body comprising therein a tubular insert for insertion therein of glue stick and having set therein a cutter to cut inserted glue stick into two halves to facilitate melting process; a feed control mechanism to control the feeding of inserted glue stick and the output of melted glue; an ignition mechanism and a gas volume regulating mechanism to efficiently ignite sparks to burn cotton asbestos by means of gas volume control so as to efficiently melt the inserted glue stick into semiliquid.

BRIEF DESCRIPTION OF THE DRAWINGS

FIG. 1—1 is a perspective view of the front portion of the gas ignition glue gun of this invention;

DETAILED DESCRIPTION OF THE PREFERRED EMBODIMENT

Figure 1:
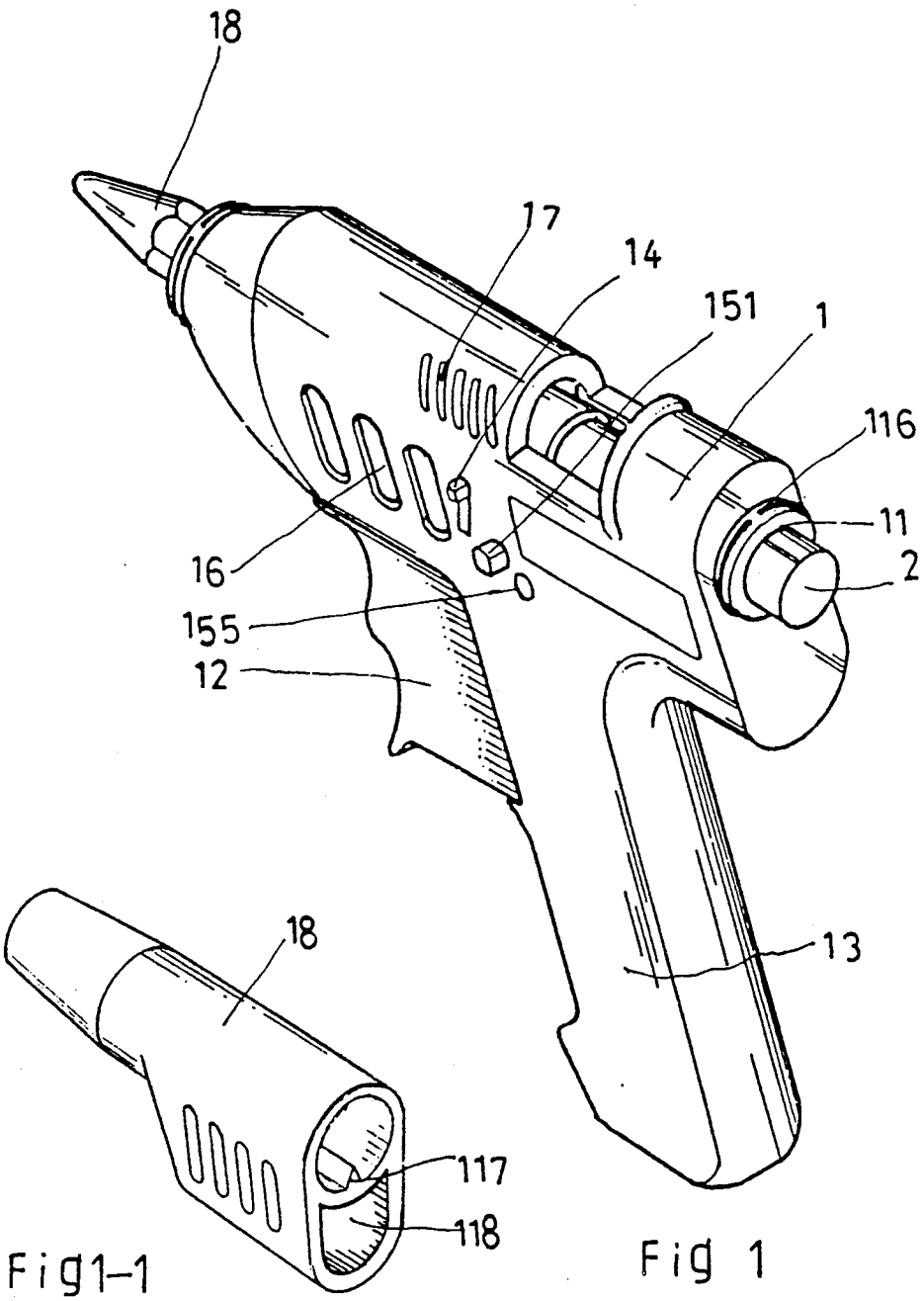
FIG. 1 is a perspective view of a gas ignition glue gun embodying the present invention.

Referring to FIG. 1, a gas ignition glue gun according to the present invention is generally comprised of a gun body (1) having inserted therein a tubular insert (II) for insertion therein of a glue stick (2), a grip (13) integrally extending downward from the body (1) for holding of hand, a feed control lever (12) at the upper front portion of the grip (13) to control the feeding of glue stick, a gas volume regulating lever (14) and an ignition trigger (151) respectively mounted thereon to project therefrom at one lateral side, a plurality of radiator holes (16) and (17) on the outer wall of the body (1), and a nozzle (18) at the front.

Figure 2:
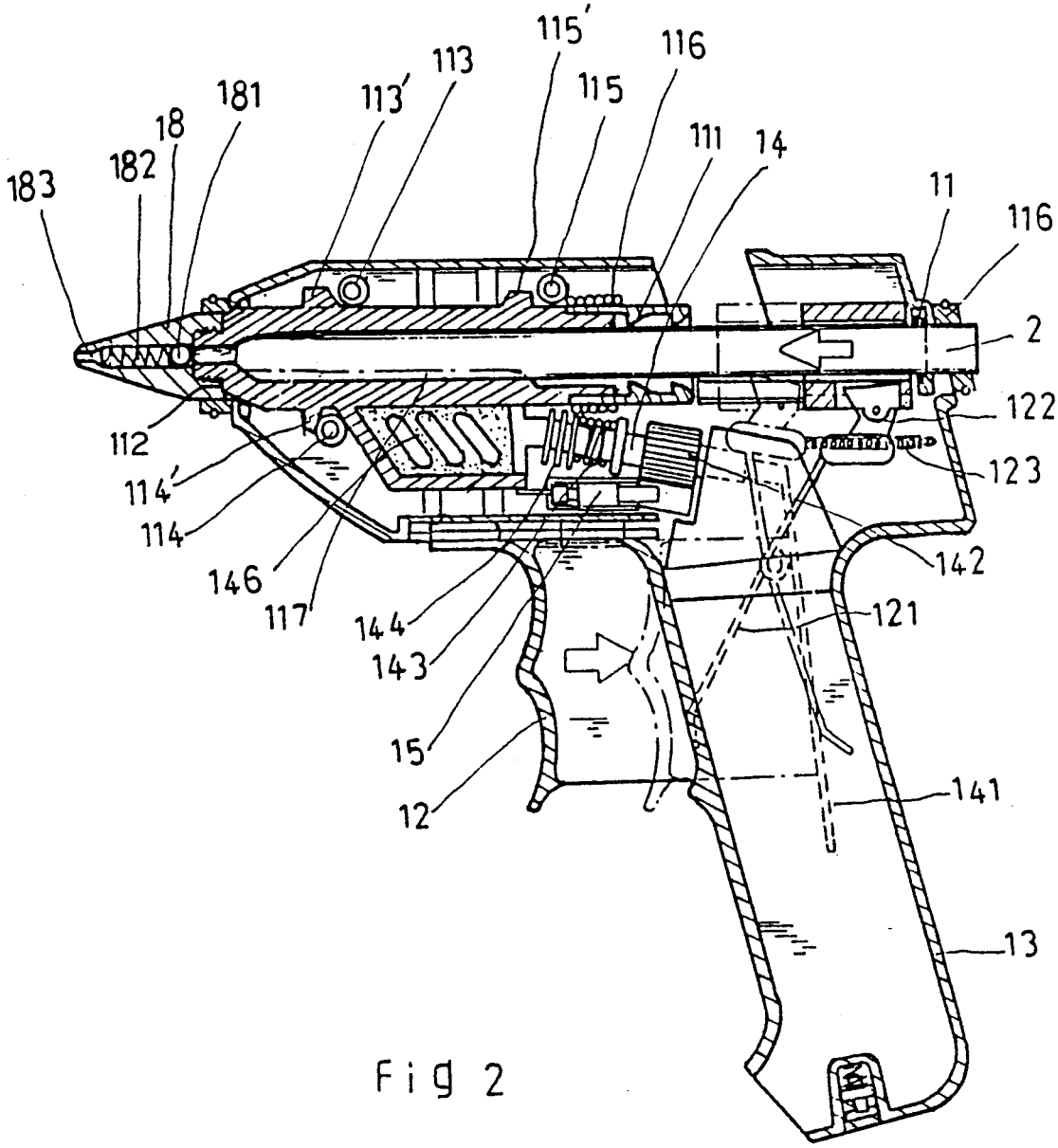
FIG. 2 is a sectional elevation of the present invention.

Referring to FIG. 2, when the feed control lever (12) is pressed on, as the arrow indicates, the lower end of the resilient element (121) is pushed backward, therefore, the clamping element (122), which is fixedly connected to the top end of the resilient element (121) is pushed to drive the glue stick (2) to move forward. As soon as the feed control lever (12) is released, the resilient element (121) is immediately driven by a positioning spring (123) to return to the original position. Because the glue stick (2) is controlled by the positioning spring (123), if the glue stick (2) is not completely melted, or the feed control lever (12) is idly pressed on, the internal mechanism of the device will not be damaged. A hook-like retainer ring (111) made of silicone rubber is set in the tubular insert (11) in the middle to firmly retain the glue stick (2). A spring (116) is mounted on the hook-like retainer ring (111) at the front end to firmly retain the hook-like retainer ring (111) so as to prevent the reverse flow of melted glue. The tubular insert (11) comprises a bevel front end (112) to which the nozzle (18) is connected. The nozzle (18) comprises an axial bore (183) having set therein a feeding device comprised of a ball (181) and a spring (182) to push melted glue out of the axial bore (183). The tubular insert (11) is comprised of a front half portion and a rear half portion and comprises a plurality of raised blocks (113), (114) and (115) integrally made at the front half portion. When the tubular insert (11) is inserted into the gun body (1), the raised blocks (113), (114) and (115) are respectively engaged with the projecting blocks (113)', (114)' and (115)' of the gun body (1), and the tubular insert (11) becomes firmly positioned in the gun body (1) with the rear end of the front half portion set in alignment with the rear half portion. A cutter (117) is set in the tubular insert (11) at the front end. It may be heated to cut the inserted glue stick (2) into two semi-circular parts to facilitate melting process. A gas tube (141) is set in the grip (13) to guide gas to a gear wheel (142). The gas volume regulating lever (14), a return spring (143) and a radiator fin (144) are respectively set at the front of the gear wheel (142). The gas from the gas guide tube (141) is, after passing through the gear wheel (142), guided to a lead hole (145) where the gas is mixed with air to heat a heating hole (118) and the cutter (117), by means of the cotton asbestos (146), so as to further melt the inserted glue stick (2). By means of the effect of the cotton asbestos (146), ejected gas is collected for complete burning to minimize the loss. According to the present invention, the igniter (15) is set at the inner bottom of the gun body (1).

Figure 3:
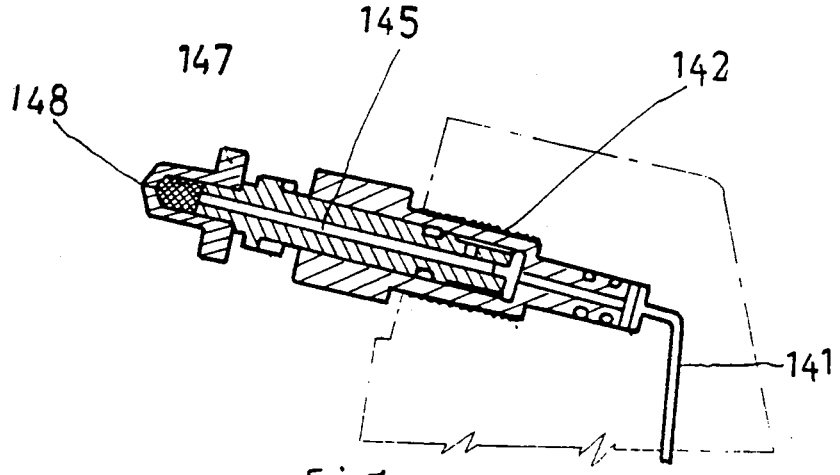
FIG. 3 is a sectional view of the present invention, illustrating the structure of the gas guide tube, the gear wheel, the cotton asbestos and the jet.
Figure 4:
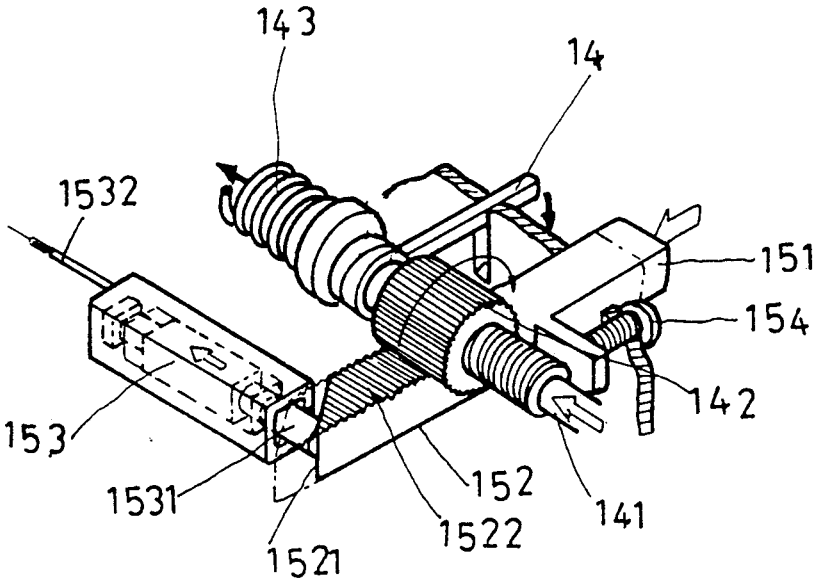
FIG. 4 is a schematic structural view of the ignition mechanism of the present invention.

With respect to the ignition process of the present invention, please refer to FIGS. 3 and 4. When the ignition trigger (151) is triggered to push the main rd (152) to move leftward, the front bevel edge (1521) of the main rod (152) is simultaneously driven to push the triggering rod (1531) to move forward to further trigger the igniter (153) to ignite sparks through the front ignition tube (1532). While the main rod (152) is pushed to move leftward, the rack portion (1522) simultaneously drives the gear wheel (142) to rotate along the direction the arrow indicates (see FIG. 4) to permit output of gas from the gas tube (141) for burning. After triggering, the ignition trigger (151) is immediately returned to original position, and the gear wheel (142) is simutaneously driven to turn to the original position. When the gas volume regulating lever (14) is pressed down, the two circular ends of the gas volume regulating lever (14) immediately squeeze the return spring (143) forward. At the time, a screw driver may be inserted through the hole (155) of the gun body (1) to screw in or out the regulating screw (154) so as to control the intensity of flame. As shown in FIG. 3, the gas from the gas tube (141) is delivered through the lead hole (145), the jet (148) of the injection head (147), and into the cotton asbestos (146) for burning.

In the present embodiment, the nozzle (18) has a conical front end and a hexagonal rear end to permit melted glue be ejected in a thread. In actual practice, the nozzle (18) may be alternatively replaced by any other type of nozzles according to requirement.

I claim:

1. A gas ignition glue gun, including:

a gun body comprising therein a tubular insert for insertion therein of a glue stick, said tubular insert being comprised of a front half portion and a rear half portion, said front half portion comprising integrally a plurality of raised blocks firmly retained by a plurality of projecting blocks to become firmly positioned in alignment with said rear half portion, a nozzle with an axial bore, screwed onto said tubular insert at the front through which melted glue may be ejected, a plurality of radiator holes on side wall portion of the gun body to help radiation of heat, a feed control mechanism comprising a feed control lever, a resilient element connected with said feed control lever, a clamping element connected with said resilient element at the top to retain the glue stick inserted into said tubular insert, a return spring connected with said clamping element at the back side, a spring and a connected hook-like retainer ring made of silicone rubber set in said tubular insert in the middle to firmly retain the glue stick inserted therein, a cutter set in said tubular insert to cut the inserted glue stick into two semi-circular halves, and a spring and a connected ball set in the axial bore of said nozzle;

an ignition mechanism set in said gun body, comprising an ignition trigger disposed to protrude beyond the outer wall surface of said bun body, a main rod comprising a rack portion at the top and being connected with said ignition trigger, a triggering rod in contact with the front bevel edge of said main rod, an igniter connected with said triggering rod, said igniter comprising a ignition tube at the front through which sparks may be ignited;

a gas volume regulating mechanism set in said gun body, comprising a gas volume regulating lever disposed to protrude beyond the outer wall surface of said gun body, a gear wheel connected with said gas volume regulating lever at the front and disposed to engage with the rack portion of said main rod, a return spring and a radiator fin connected to said gas volume regulating lever at the back, a cotton asbestos set at the front of the gas volume regulating mechanism adjacent to said tubular insert and being covered by a metal cover of high heat conductivity;

characterized in that said feed control mechanism controls forward feeding of glue stick, said ignition mechanism and said gas volume regulating mechanism control spark ignition and intensity of flame to completely melt the glue stick into liquid.

2. The gas ignition glue gun as set forth in claim 1, wherein the spring and the connected hook-like retainer ring made of silicon rubber ring which are set in said tubular insert in the middle to firmly retain the glue stick are to prohibit reverse flow of melted glue; the front half portion of said tubular insert being firmly positioned by means of the engagement of the said plurality of raised blocks with the said plurality of projecting blocks to facilitate alignment with the rear half portion; the spring and the connected ball which are set in the axial bore of the nozzle in order to push melted glue out of the gun body.

3. The gas ignition glue gun as set forth in claim 1, wherein a heating hole is disposed at the bottom of the tubular insert where gas is burned to uniformly heat the tubular insert and the cutter set therein so as to efficiently cut the inserted glue stick into halves and melt the inserted glue stick into liquid.

* * * * *